United States Patent [19]

Shimizu et al.

[11] Patent Number: 4,743,483

[45] Date of Patent: May 10, 1988

[54] NAPPED SHEET HAVING A PATTERN THEREON AND METHOD FOR ITS PRODUCTION

[75] Inventors: Hisao Shimizu, Otsu; Koji Watanabe, Kusatsu; Miyoshi Okamoto, Takatsuki, all of Japan

[73] Assignee: Toray Industries, Inc., Otsu, Japan

[21] Appl. No.: 937,093

[22] Filed: Dec. 2, 1986

[30] Foreign Application Priority Data

Dec. 5, 1985 [JP] Japan ..... 60-273816
Dec. 23, 1985 [JP] Japan ..... 60-287825
Mar. 4, 1986 [JP] Japan ..... 61-45162

[51] Int. Cl.[4] ..... B32B 3/02; B32B 33/00

[52] U.S. Cl. ..... 428/89; 26/2 R; 428/91

[58] Field of Search ..... 428/89, 91; 26/2 R

[56] References Cited

U.S. PATENT DOCUMENTS 4,497,095 2/1985 Minemura et al. ..... 26/2 R

*Primary Examiner*—Marion C. McCamish
*Attorney, Agent, or Firm*—Austin R. Miller

[57] ABSTRACT

A napped sheet has a pattern thereon formed by the sharp contrast between an area with a nap surface and an area with a reversed nap surface on which nap ends are reversed and extend into the inner part of the sheet.

A process for producing the sheet includes the step of first raising a fiber sheet and next impinging a high-pressure columnar fluid jet stream on part of the fiber sheet.

The product of the invention is soft, strong and beautiful, and has good durability. The production process is simple and inexpensive.

20 Claims, 5 Drawing Sheets

NAPPED SHEET HAVING A PATTERN THEREON AND METHOD FOR ITS PRODUCTION

BACKGROUND OF THE INVENTION

1. Field of the Invention

This invention relates to patterned napped sheets and to methods for their production.

2. Description of Prior Art

Artificial suedes having elegant appearance and touch have been widely used. As a result, novel surface appearances are demanded.

Conventional methods for forming a pattern on the nap surface—besides printing with dyestuff—are embossing, singeing after temporary printing with a sizing agent, printing a dissolving or decomposing agent for naps or printing a resin.

However, all of these processes suffer from drawbacks such as decreasing the strength or hardening to the touch. Especially, the surface touch characteristic of ultrafine fibers is seriously damaged on the modified surface. Moreover, in the embossing, a different roll is necessary for every pattern and the other processes necessitate treating agents.

U.S. Pat. No. 4,497,095 disclosed a method for making the appearance of a raised fabric suede-like by jet spraying a high pressure liquid onto the nap surface. However, in this method, conical or sectoral spray was directed to a fabric through a partially closed mesh disposed in spaced relation to the fabric. Thus the U.S. patent disclosed a method for producing the beauty of light and shade on the artificial suede resulting from an anisotropic or random arrangement of the nap as seen with natural suede and, on the other hand, a sharp pattern of the nap surface was not disclosed nor suggested.

SUMMARY OF THE INVENTION

It is an object of this invention to provide a napped sheet having a sharp pattern thereon, which is excellent in durability without detriment to the appearance of naps, softness and strength. The production process which is simple and inexpensive.

This invention provides a napped sheet having a pattern on at least one surface, said surface being composed of an area with a nap surface (herein called a "nap area" ) and an area with a reversed nap surface (herein called a "reversed nap area") on which nap ends are extending into the inner part of the sheet or protrude through the opposite surface of the sheet, the width of the intermediate zone between the two areas being not more than 1 mm. Preferably the nap density of the nap area is more than twice that of the reversed nap area.

This invention also provides a process for producing a napped sheet having a pattern thereon by impinging a high-pressure fluid jet stream on part of a fiber sheet, the fiber sheet having been raised before impinging by the high-pressure fluid.

DESCRIPTION OF THE PREFERRED EMBODIMENTS

Figure 1:
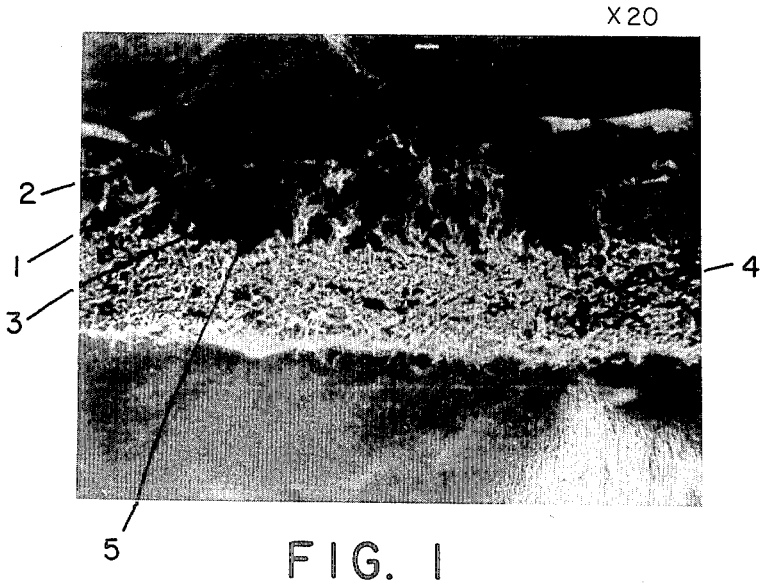
FIG. 1 is an enlarged cross-section of a napped sheet according to the invention.

The napped sheet of this invention may be nonwoven, woven, knitted or a composite fabric. The composite sheet can be, for example, formed by intertwining nonwoven web with a woven or knitted fabric by needle punching or water jet punching. Of course these sheets may include an elastomer. The nap may be formed by raising a fiber sheet, for example by buffing with sand paper or by raising with card cloth. The nap fiber is preferably an ultrafine fiber. Ultrafine fiber nap has high quality appearance and can effectively and firmly be reversed by directing fluid jet stream to form a sharp pattern on the nap surface.

The woven or knitted fabrics used in this invention include weft knitted fabrics, warp knitted fabrics such as tricot fabric, lace stitch fabric, woven fabrics such as plain weave fabric, twill fabric and satin fabric, and they are not particularly limited. However, multilayer structure fabric such as twill or satin in which the surface layer comprises ultrafine fibers is preferred, because it easily provides ultrafine fiber naps by raising.

In the case of the above mentioned composite fabric, the weight of woven or knitted fabrics is 10 to 100 $g/m^2$, preferabiy, 30 to 70 $g/m^2$. On the other hand, the weight of the web to be intertwined is 100 to 500 $g/m^2$, preferably 150 to 300 $g/m^2$. Further, it is preferable from the viewpoint of flexibility that the fineness of the constituent yarn is 100 denier or less and that of the monofilament is 5 denier or less. Further, the constituent fiber may have a twist. High twist of the constituent yarns brings about softness in the composite sheet and decreases damage the woven or knitted fabric by the needle punching with the nonwoven web.

The sheet may comprise binder. When the base sheet is a non-woven sheet, the amount of the binder is preferably 5 to 50 weight %, more preferably, 10 to 40 weight % based on the total weight of the product. On the other hand, when the base sheet is a woven or knitted sheet, the amount of binder is preferably 1 to 20 weight %, more preferably 2 to 10 weight % based on the total weight of the product.

Examples of said ultrafine fibers include those obtained from islands-in-sea fibers, peelable conjugated fibers such as radially multi-layered hollow fiber or fibers having many radially separated wedges in its cross-section and polymer blend fibers, and materials therefor include polyesters, polyamides, polyacrylics, etc., which may be used as mixtures with elastic fibers such as polyester elastomers, polyurethane elastomers, polyisoprene or polybutadiene. When a low-melting point elastomer used, it may be possible to melt the elastomer to bind the remaining fibers instead of impregnating with a binder.

Natural fibers such as cotton, rayon or wool, or inorganic fibers may be incorporated, or coarse yarns may also be incorporated in amounts within limits not detrimental to the effects of this invention.

It is preferable that the fineness of the ultrafine fibers is 0.8 denier or less, more preferably, 0.5 denier or less, most preferably, 0.2 denier or less from the viewpoints of the nap quality and the ease with which naps can be reversed by the jet stream. As the fineness of the nap fibers is increased, sharp patterns can be formed by using a finer jet stream, and it becomes possible to form a variety of delicate and complicated patterns.

Although the length of the nap is not particularly limited, it is preferably 0.01 to 5 mm, more desirably 0.1 to 3 mm.

Although the density of the nap is not particularly limited, it is preferably, 10000 naps per square centimeter or higher, more preferably, 50000 naps per square centimeter or higher.

Elastomers to be imparted to the sheet include polyurethanes, polyacrylics and natural rubbers, to which pigments, dyes, stabilizers, etc., may be added, if required.

The methods for raising are not particularly limited and include well-known ones such as raising by means of a card clothing raising machine or buffing with sand paper.

According to this invention, a variety of patterns can be formed by forming reversed naps in a contiguous or noncontiguous form on the napped sheet.

More specifically, reversed naps are formed by applying a high-pressure fluid jet stream to the napped sheet to allow the nap fibers to be reversed and extend into the base layer and, in some cases, at the same time to allow part of them to protrude on the back surface of the the base layer.

Thus by impinging on the napped sheet a columnar jet of a high-pressure fluid from a number of small holes of a spinneret, the struck parts can form reversed naps while the unstruck parts remain as protrusions to form a variety of patterns.

Further, a pattern can also be formed placing a templet on the nap surface.

Figure 2:
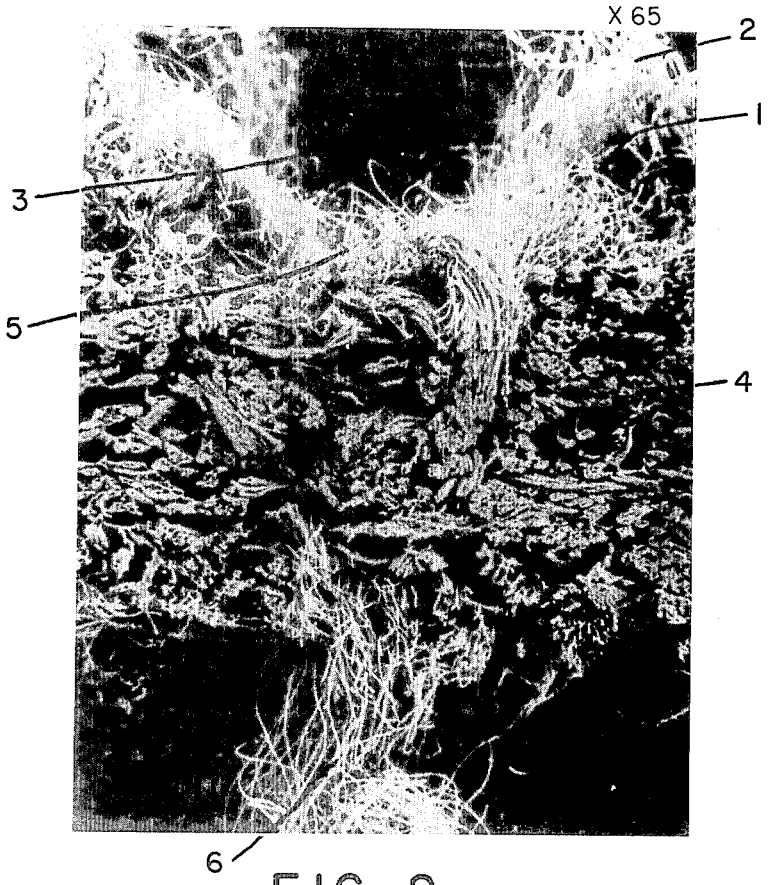
FIG. 2 is a further enlarged cross-section of another such sheet.

FIGS. 1 and 2 show cross-sections through napped sheets made by the process of this invention. In these Figures, 4 is a base layer of which the front surface has been raised to form naps 2. By applying the fluid at specified places 3 recesses are formed, causing the naps to be reversed into the base layer as shown at 5.

When the pressure is strong enough and the base layer is thin, fibers 6 protrude from the reverse side and form another pattern on the reverse surface as shown in FIG. 2.

Therefore, if the conditions are adjusted properly, a reversible fabric having patterns on both surfaces can be made.

When the high-pressure fluid jet stream treatment is applied to a napped sheet comprising an ultrafine fiber and a binder (elastomer), the reversed naps are entangled with base layer fibers and at the same time entangled with the binder. In some cases, the binder is partly broken, so that the reversed naps are tightly held within the base layer. Thus formed pattern will not be damaged even by a strong rubbing action in jet dyeing, repeated dry cleaning or long-term wear.

Further, because the binder is partly broken and entangled with the fibers, the touch becomes soft without serious loss of strength.

Especially, the napped sheet of a woven or knitted fabric or a composite sheet thereof is substantially free of loss of strength. Further, because of good dimensional stability and so no dimensional change in processing, it is suitable for forming a delicate pattern.

Since most of the fluid of the jet stream passes through the sheet, it scarcely influences other parts. Therefore, elegant mottling effect like natural suede, light and dark effect, and touch which are characteristic to ultrafine naps of the parts untouched by the jet stream remain unchanged.

When the pressure of jet stream is low, sharp patterns cannot be formed, and good durability cannot be attained. On the contrary, when the pressure is excessively high, the sheet is weakened or broken. Therefore, it is preferable that the jet pressure is about 10 to 200 $kg/cm^2$, more preferably, about 20 to 150 $kg/cm^2$. The pressure should be suitably controlled within this range according to the other conditions such as nap length and fineness of the nap, thickness of the napped sheet, the kind of pattern, the diameter of the small holes for impinging a jet stream, and processing speed.

If a spinneret having a row of small holes disposed apart is oscillated in the transverse and/or longitudinal direction of the napped sheet, various curved geometrical patterns can be obtained by changing the processing speed, oscillating speed, and oscillating width. For example, linear stripe patterns (FIGS. 4(*a*)) and (*b*)), a wavy pattern (FIG. 4(*c*)), a zigzag pattern (FIG. 3 (*d*)) and a cycloid pattern (FIG. 4(*e*)) can be obtained. Further, any desired combination of patterns (FIGS. 4(*f*), (*g*) and (*h*)) can be formed.

On the other hand, by applying the jet stream over all of the area through a templet on the napped surface, any desired pattern can be formed.

The diameter of the small holes through which the jet is forced may be about 0.1 to 0.5 mm, preferably about 0.2 to 0.4 mm.

Although the spacing among small holes of the spinnerets is not particularly limited, it is desirably 0.3 or above, preferably 1.0 or above, to give distinctness of pattern. By spacing about 1.0 mm, sharp parallel lines of reversed nap can be produced without using templet. This means that the width of the intermediate zone from the nap area to the reversed nap area can be narrower than 0.5 mm. As a matter of course, it is easy to decrease the width of the zone narrower than 1 mm.

The shape of the small holes is not particularly limited; they may be a variety of shapes such as circles, polygons, multilobar or slit form. However circles are preferred because they facilitate jetting a columnar stream.

Although several kinds of fluid such as water, air or steam can be used, a liquid is preferable and water is the most suitable. The water may contain, for example, a variety of treating agents, oils, water-repellents, solvents, etc.

As a matter of course, either cold water or hot water can be used.

Any patterns composed of lines and faces, such as stripe, wavy, zig-zag, mesh, polka-dotted, floral, or animal-skin-like patterns can be obtained.

The templets which can be used in forming a pattern for this invention include sheets of metal, ceramics, plastics, film, some kind of paper, rubber or the like, fibrous sheets such as lace, coursely knitted or woven fabric, mesh products such as a screen gauze and screen stencil for printing and adhesive tapes, and are not particularly limited as long as they are neither attacked nor broken by a high-pressure fluid jet stream. Among other choices, screen stencils or stainless steel templets are desirable because of their shape stability, durability, etc. It is preferable to select a tough resin for screen stencil so that a design cannot be easily broken by water jet. Further, plastic templets are advantageous because of their good adhesion to the fabric to be processed.

Screen stencils are favorable because of the variety of pattern which can be improved by their use. Adhesive tapes can be valuable because they can be easily handled and can be fixed firmly and temporarily to the napped sheet during impinging of a high-pressure fluid jet stream.

These templets may be used as a single layer or a suitable combination of at least two of them.

The templet may be flat or cylindrical. The jet stream is impinged from the inside of a cylindrical templet while the templet is being rolled at the same speed as that of the napped sheet.

The effects of this invention are summarized as follows.

(1) A delicate and sharp pattern formed with naps can be formed on the napped sheet obtained by this invention.

(2) The same pattern as that on the front surface can be formed also on the reverse side of a fabric, so that this fabric is suitable as a reversible material.

(3) Because fibers which form a reversed napped pattern are entangled firmly with base layer fibers, both the loosening and abrasion resistances are good, and the pattern does not change even upon prolonged use or by repeated dry cleaning and is durable.

(4) Because of the above-mentioned structure of the reversed nap, the fabric is freed from loss of strength and hardening of touch.

(5) The beauty of the nap area is emphasized by contrast with reversed nap area because the former remains unchanged even after the process of this invention.

(6) The production method of this invention can be practiced simply and inexpensively without any special treating agent.

The nap sheets having patterns obtained by this invention can be widely used for articles of clothing, such as suits,. blazers and dresses and articles other than clothing, such as shoes, suitcases, bags, belts, furniture, car sheets, interiors, wall materials and displays.

Examples for practicing this invention will now be set forth, though it should be noted that this invention is not limited thereto.

EXAMPLE 1

A needle punching felt was made by using an island-s-in-sea fiber (16 islands; 3.0 d×51 mm; 12 crimps/in.) in which the islands/sea weight ratio is 60/40 and the island component is polyethylene terephthalate and the sea component is polystyrene.

This felt was subjected simultaneously to shrinking and sizing in a hot bath of aqueous solution of partially (15%) saponified polyvinyl alcohol and dried. Next, the polystyrene was removed from the felt by extraction with a trichlene (trichloroethylene) bath, and the felt was dried. The dried felt was impregnated with a 12% DMF solution of polyurethane, coagulated in water, washed with hot water and dried. The treated felt was sliced into two sheets. The nonsliced surfaces of the sheets were buffed with #100 sand paper and further buffed twice with #150 sand paper. The sliced surfaces were buffed twice with #150 sand paper. The buffed sheets were dyed in a high-temperature and high-pressure liquor flow dyeing machine (jet dyeing machine) to obtain colored napped sheets having a thickness of 0.8 mm and a weight of 230 g/m$^2$.

These dyed napped sheets were subjected to a high-pressure fluid jet stream treatment. A variety of patterns were formed on the surfaces of the nap sheets under water pressure of 90 kg/cm$^2$ by using a spinneret having a row of small holes. The diameter of the holes was 0.25 mm and the distance between the centers of the holes was 2.5 mm.

Figure 5A:
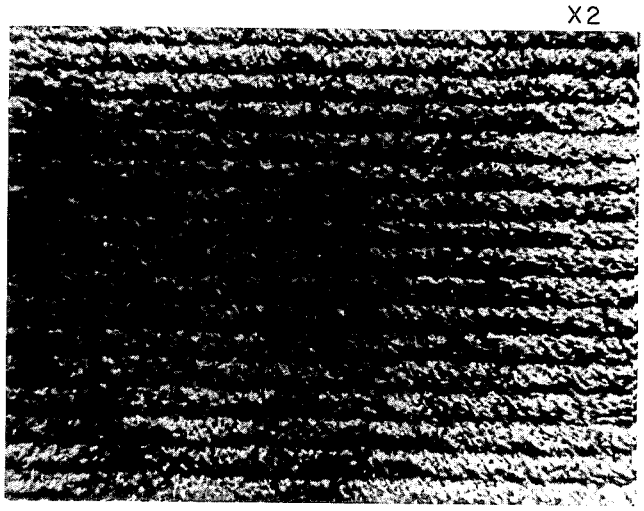
FIGS. 5(*a*) and (*b*) and FIGS. 6(*a*) and (*b*) are photographs of the front and back surfaces of napped sheets according to the invention.
Figure 5B:
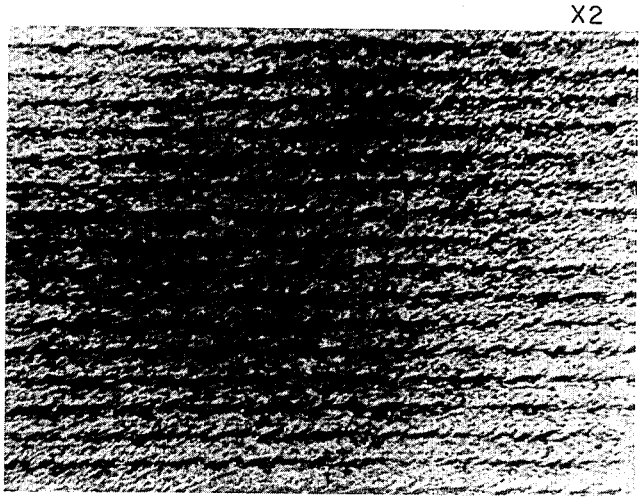

FIGS. 5 (*a*) and (*b*) show the patterns on the fibers on the front and reverse surfaces of a napped sheet (sample 1) obtained when a napped sheet was moved while the spinneret was kept unmoved.

Figure 6A:
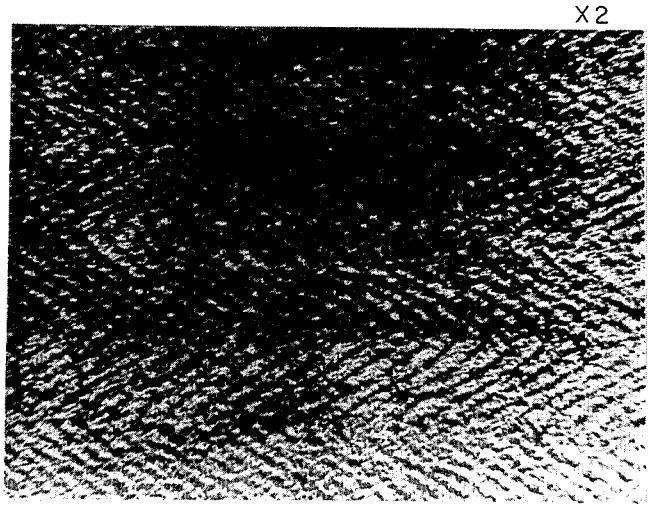
Figure 6B:
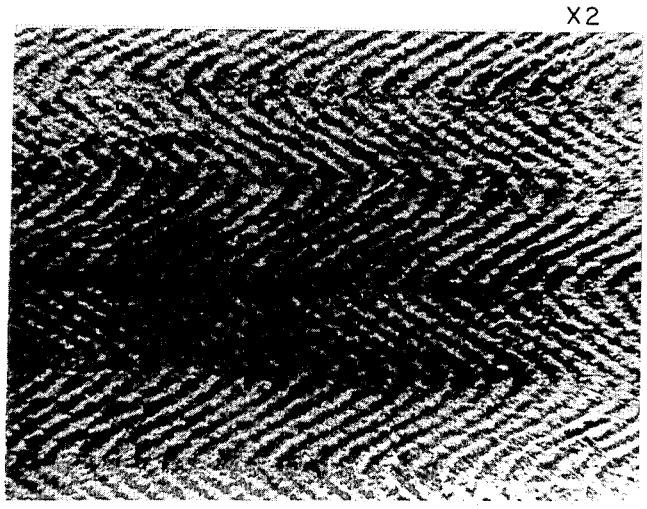

FIGS. 6 (*a*) and (*b*) show the patterns on the front and reverse surfaces of a napped sheet (sample 2) obtained when the spinneret was oscillated. In FIGS. 5 and 6, (*a*) represents the front surface and (*b*) the reverse surface. Both of the patterns were distinct and sharp. Further, this napped sheet had both mottling and lighting effects which were characteristic of a high-grade suede and was excellent in both touch and appearance.

Furthermore, the same pattern was formed also on the reverse surface of this napped sheet at the same time by the above jet stream treatment, so that the sheet was suitable also as a reversible material. At the back surface, the protrusions were formed with the reversed nap ends of the front surface.

Surface-sided and both-sided blazers were sewn from the above napped sheet. when they were dry-cleaned ten times after one-year use on the premises of the applicant company, the patterns underwent no recognizable change and neither surface loosening nor breakage of the sheet was recognized.

EXAMPLE 2

A napped sheet as used in Example 1 (not dyed) was used and a pattern was formed on this sheet under the same conditions as in Example 1, followed by dyeing. The obtained napped sheet had a pattern which was as distinct, sharp and elegant as that in Example 1.

EXAMPLE 3

A pattern was formed in the same manner as in Example 1 except that the water pressure of the jet stream was 45 kg/cm$^2$.

The pattern formed on the surface of the obtained napped sheet was was as distinct, sharp and elegant as those shown in FIGS. 5 (*a*) and 6 (*a*). However, because of low water pressure, scarcely any fiber protruded from the reverse side. A surface-sided blazer was sewn from this fabric. When it was dry-cleaned repeatedly ten times after one-year use on the premise of the applicant company, the pattern underwent no recognizable change and neither surface loosening nor breakage of the reversed naps was recognized at all.

EXAMPLE 4

A dyed napped sheet was prepared according to the same procedures of Example 1, in which the island/sea weight ratio and the PU concentration of DMF solution were changed to 50/50 and 13% respectively. The amount of PU adhered was 52 weight parts per 100 weight parts of fibers at the slicing. After dyeing, the colored napped sheet had a thickness of 0.81 mm and a weight of 225 g/m$^2$.

A stainless steel plate having a punched floral pattern was placed on the surface of the naps of each of the dyed napped sheets, and the jet stream was impinged against the surface while oscillating the spinneret over the whole surface (cover factor=100) to form a regular floral pattern composed of reversed naps on the struck parts and protrusions on the unstruck parts. These floral patterns were distinct and sharp.

Furthermore, the same pattern was formed also on the reverse surface of this napped sheet at the same time by the above jet stream treatment, so that it was suitable also as a reversible material.

Surface-sided and both-sided dresses were sewn from the above napped sheet. When they were dry-cleaned repeatedly five times after one-season use on the premises of the applicant company, the patterns underwent no recognizable change and neither surface loosening nor breakage of reversed naps was recognized at all.

EXAMPLE 5

A napped sheet as used in Example 1 (not dyed) was used and a pattern was formed on this sheet under the same conditions as in Example 4, followed by dyeing. The obtained napped sheet was free from deformation though it was dyed after the pattern was formed, and had a pattern which was as distinct and elegant as that in Example 1.

EXAMPLE 6

A pattern was formed in the same manner as in Example 4 except that the water pressure of the jet stream was 50 kg/cm$^2$.

The pattern formed on the front surface was as distinct and elegant as those in Example 1 though the water pressure was lower. However, because of low water pressure, no distinct pattern could be formed on the reverse side.

A surface-sided dress was sewn from this fabric. When it was dry-cleaned repeatedly five times after one-season use on the premises of the applicant company, the pattern underwent no recognizable change and neither surface loosening nor breakage was recognized.

COMPARATIVE EXAMPLE 1

The reverse side of a napped sheet was tightly placed on a templet, and a fluid was impinged against the surface of the naps under the same condition as in Example 1. However, no distinct pattern could be formed on either the front or reverse surfaces.

COMPARATIVE EXAMPLE 2

The same napped sheet as in Example 4 was used. The reverse side of this fabric was tightly placed on a templet having randomly formed unevennesses as in U.S. Pat. No. 4,497,095, and a fluid was impinged against the surface of the naps through a randomly punched screen. Although tests were repeated under a fluid pressure of 5 to 100 kg/cm$^2$, varying the degree of unevenness of the templet, the pattern of unevenness and the mesh number of the screen, etc., no sharp pattern aimed at in this invention could be obtained though random shaded patterns could be obtained.

EXAMPLE 7

A islands-in-sea fiber was obtained by melt-spinning 55 parts by weight of polyethylene terephthalate as an island component and 45 parts by weight of polystyrene as a sea component and drawing the fiber. An ultrafine fiber bundle (the number of islands was 16) having a monofilament fineness of 0.13 d and a fiber bundle fineness of 3.8 d was obtained by extracting the sea component of the islands-in-sea fiber with trichlene. A plurality of these fiber bundles were formed into a tow and cut into short fibers of a length of 4 mm by means of a cutter. The obtained short fibers were mainly composed of fiber bundles of units of sixteen gathered ultrafine fibers of 0.13 d.

These short fibers were dispersed in water to form a 0.1% concentration slurry. This slurry was made into a sheet with a two-layer paper machine while a rough woven fabric of 40 g/m$^2$ (woven from warps and wefts of hard twisted yarn of polyethylene terephthalate 86 d/36 f, 1100 T/m) was inserted as an intermediate layer to obtain a three-layer laminated sheet of a structure of short fiber/woven fabric/short fiber. The weight of the obtained sheet was 100 g/m$^2$ for both of the upper and lower layers.

An entangled sheet was obtained by striking the front and reverse surfaces of the three-layer sheet with a high-pressure water flow impinged at 15 kg/cm$^2$ from a nozzle with a hole diameter of 0.2 mm and treating both the surfaces with a high-pressure water flow at 30 kg/cm$^2$.

The obtained entangled sheet was one in which the ultrafine fibers were separated and dispersed substantially as monofilaments.

Further, this entangled sheet was impregnated with a 12% aqueous polyvinyl alcohol solution and dried. The resulting sheet was impregnated with a 12% DMF solution of polyurethane, coagulated in water, washed with hot water and dried. The treated sheet was buffed with sand paper to obtain a napped sheet. This sheet was dyed in a high-temperature and high-pressure liquor flow dyeing machine to obtain a colored napped sheet of a thickness of 0.75 mm and a weight of 230 g/m$^2$.

The dyed napped sheet was subjected to a high-pressure fluid jet stream treatment. A stripe pattern was formed on the surface of the napped sheet under water pressure of 90 kg/cm$^2$ by using a spinneret having a row of small holes of 0.25 mm diameter, the pitch between the centers of the hole being 2.5 mm.

Figure 3:
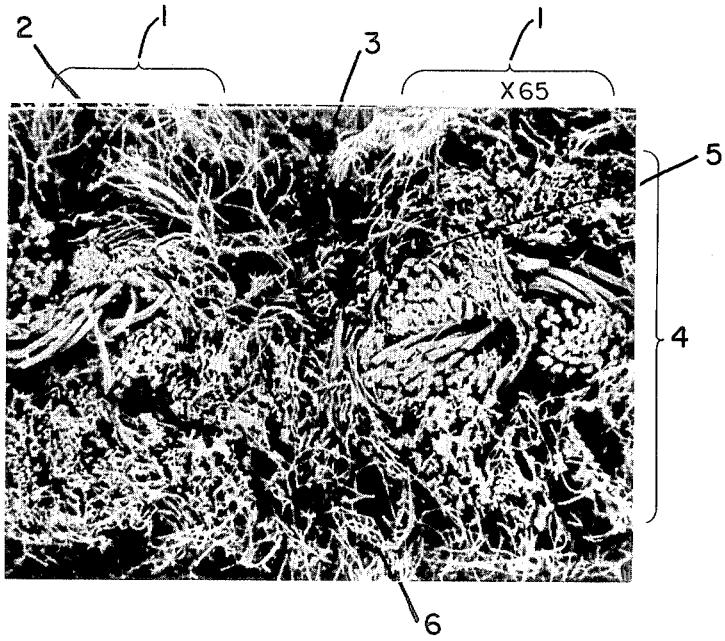
FIG. 3 shows a cross-section through a napped sheet having a woven central layer.
Figure 4A:
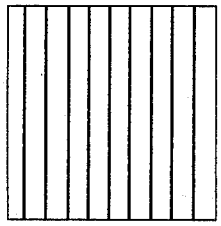
FIG. 4(*a*) to (*h*) are schematic views showing examples of patterns which can be obtained.
Figure 4B:
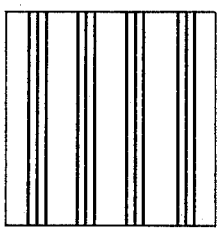
Figure 4C:
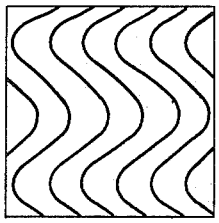
Figure 4D:
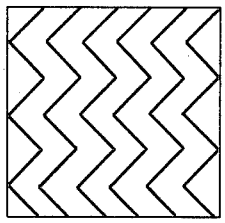
Figure 4E:
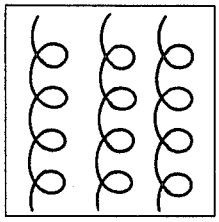
Figure 4F:
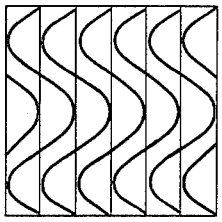
Figure 4G:
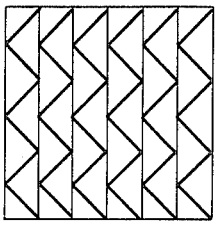
Figure 4H:
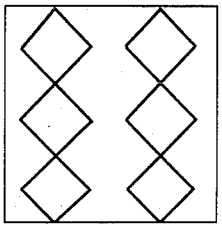

FIG. 3 is a photograph of a crosssection of the reversed nap and protrusion of this napped sheet, the woven center layer being shown at 7. The pattern was distinct and sharp.

Furthermore, a pattern could be formed also on the reverse surface of this napped sheet, so that it was suitable also as a reversible material.

Surface-sided and both-sided blazers were sewn from the above napped sheet. When they were dry-cleaned repeatedly ten times after one-year use on the premises of the applicant company, the patterns underwent no recognizable change and neither surface loosening nor breakage was recognized.

EXAMPLE 8

A pattern was formed in the same manner as in Example 7 except that the water pressure was 45 kg/cm$^2$.

The pattern was as distinct, sharp and elegant as that of the napped sheet in Example 7, though the water pressure was lower. However, because of low water pressure, scarcely any fibers protruded from the reverse side, so that no distinct pattern was formed on this side.

A surface-sided blazer was sewn from this sheet. when it was dry-cleaned repeatedly ten times after one-year use on the premises of the applicant company, the pattern underwent no recognizable change and neither surface loosening nor breakage of sheet was recognized.

EXAMPLE 9

An undrawn yarn was obtained by melt-spinning polyethylene terephthalate in a usual manner. This undrawn yarn was drawn in multiple stages to obtain a drawn yarn having a monofilament of 0.15 d and a number of filaments of 216. This yarn was formed into a tow and cut to a length of 4 mm. These short fibers were treated in the same manner as in Example 7 to obtain a colored napped sheet of a thickness of 0.75 mm and a weight of 230 g/m$^2$.

A screen stencil was placed on the surface of the naps of this dyed napped sheet and a stream was impinged (cover factor of 100) against it under a water pressure of 90 kg/cm$^2$ by using a oscillating spinneret having a row of small holes of 0.2 mm diameter, the pitch between the center of the holes being 2.5 mm.

This pattern was distinct and sharp. Furthermore, the same pattern could be formed also on the reverse surface of this napped sheet, so that it was suitable also as a reversible material.

Surface-sided and both-sided dresses were sewn from the above napped sheet. when they were dry-cleaned repeatedly five times after one-season use on the premises of the applicant company, the patterns underwent no recognizable change and neither surface loosening nor breakage of the sheet was recognized.

EXAMPLE 10

A raised 5-end satin fabric was prepared substantially according to the method disclosed in Example 1 of U.S. Pat. No. 4,136,221. The raised fabric dyed brown in jet dyeing machine. The dyed fabric has the following construction.

Warp and second weft: 50 D-24 fil. modified textured yarn

First weft: 190 D-1440 fil.

Warp density: 184 Yarns/inch

Weft density: 97.5 yarns/inch each

A screen stencil having a flower design drawn by narrow lines was placed on the nap and a stream was impinged (cover factor of 100) against it under a water pressure of 30 kg/cm$^2$ by using a oscillating (60 mm stroke and 3 cycles/sec) spinneret having a row of small holes of 0.25 mm diameter, the pitch between the center of the holes being 2.5 mm. The processing speed was 0.25 m/min.

Thus obtained product showed a sharp contrast between the stricken area, in which the weave construction is visible, and the unstricken area which remained suede like.

We claim:

1. A napped sheet having a sharp, non-random pattern on at least one surface, said surface being composed of a nap area and a reversed nap area on which nap ends are extending into the inner part or through the opposite surface of the sheet, the width of the intermediate zone between the two areas being not more than 1 mm.

2. A napped sheet according to claim 1, wherein the nap density of the nap area is more than twice of the reversed nap area.

3. A napped sheet according to claim 1, wherein said sheet contains an elastomer.

4. A napped sheet according to claim 1, wherein the nap fibers are ultrafine fibers having a fineness of 0.8 denier or less.

5. A napped sheet according to claim 1, wherein the nap fibers have a length of 10 mm or less.

6. A napped sheet according to claim 1, wherein the sheet is non-woven fabric.

7. A napped sheet according to claim 1, wherein the sheet is a woven or knitted fabric.

8. A napped sheet according to claim 1, wherein the sheet is a composite sheet comprising a non-woven sheet and a woven or knitted fabric.

9. A napped sheet according to claim 1, wherein said reversed naps protrude at the reverse surface.

10. A process for producing a napped sheet having a sharp, non-random pattern thereon, comprising impinging a high-pressure fluid jet stream on parts of a fiber sheet, said fiber sheet having been raised to form a napped surface before impringing by the high-pressure fluid, said jet stream reversing naps on said impinged parts and entangling them with base layer fibers in said fiber sheet and forming an intermediate zone between said reversed naps and said nappped surface having a width not more than 1 mm.

11. A process according to claim 10, wherein said fiber sheet is non-woven fiber sheet.

12. A process according to claim 10, wherein said fiber sheet is a woven or knitted fiber sheet.

13. A process according to any one of claims 10, wherein the pressure of said high-pressure fluid jet stream is 10 to 200 kg/cm$^2$.

14. A process according to any one of claim 10, wherein the fluid is a liquid and the jet stream is columnar jet stream.

15. A process according to claim 14, wherein said fluid is water.

16. A process according to claim 15, wherein said high-pressure fluid jet stream is oscillated.

17. A process according to claim 10, wherein said fiber sheet is raised with sand paper.

18. A process according to claim 10, wherein said fiber sheet is raised with card cloth.

19. A process according to claim 10, wherein a templet is placed on said nap surface.

20. A process according to claim 19, wherein said templet is a screen stencil.

* * * * *